United States Patent [19]

Matteini

[11] 4,236,465

[45] Dec. 2, 1980

[54] MATERIAL LEVEL CHECKING APPARATUS FOR USE IN A ROTARY INCINERATING FURNACE

[76] Inventor: Silvano Matteini, Via Bellosguardo 4A, Florence, Italy

[21] Appl. No.: 3,973

[22] Filed: Jan. 16, 1979

[51] Int. Cl.[3] ..... F23G 5/06

[52] U.S. Cl. ..... 110/246; 432/103; 73/290 R; 340/615; 340/617

[58] Field of Search ..... 110/246; 432/103, 118; 73/290 R; 340/615, 617

[56] References Cited

U.S. PATENT DOCUMENTS

| | | | |
|---|---|---|---|
| 1,239,315 | 9/1917 | Stine | 340/615 |
| 3,019,310 | 1/1962 | Hoff | 340/617 |
| 3,098,458 | 7/1963 | Lantz, Jr. | 110/246 |
| 3,510,861 | 5/1970 | McIver et al. | 340/615 |
| 3,560,752 | 2/1971 | Lee | 340/615 |

*Primary Examiner*—Henry C. Yuen

*Attorney, Agent, or Firm*—Hopgood, Calimafde, Kalil, Blaustein & Leiberman

[57] ABSTRACT

A freely oscillating moving element (12-14-16), according to a radial axis with respect to the furnace wall (1) and having an inner appendix (12) deviated from the axis and with an outer counter-weight (16), can oscillate between two angular positions defined by pawls, towards the first of such positions said moving element is cyclically moved during the moving element lowering trajectory with the rotation of the furnace while towards the second angular position said moving element is cyclically moved during the moving element raising trajectory with the furnace rotation; said moving element can reach said second position only when the inner appendix (12) emerges from the material contained in the furnace.

4 Claims, 10 Drawing Figures

MATERIAL LEVEL CHECKING APPARATUS FOR USE IN A ROTARY INCINERATING FURNACE

The invention relates to a material level signalling and/or checking apparatus in a refuse incinerating rotary cylindrical furnace. The apparatus ensures a regular working in spite of the hard environment where it is located, and can perform a lowered condition signal of the existing material level, or can also carry out a control for the regulation and/or restoration of said level.

According to the invention the apparatus substantially comprises freely oscillating moving element according to a radial axis with respect to the furnace wall, with an inner appendix deviated from the axis and with an outer counterweight; said moving element is apt to oscillate between two angular positions defined by pawls, towards the first of such positions said moving element is cyclically moved during the moving element lowering trajectory with the rotation of the furnace, while towards the second angular position said moving element is cyclically moved during the moving element raising trajectory with the rotation of the furnace; said moving element can reach said other position only when said inner appendix emerges from the material contained in the furnace.

The first angular position can correspond to the position of the inner appendix substantially lying on a transversal plane with respect to the furnace rotation axis.

Said oscillating moving element can comprise an eccentric projection that changes its position when the moving element bears against the one or the other pawl; on the fixed structure at least one position detector of said eccentric projection is provided, when it is in one of the two positions in the oscillating moving element rising trajectory length. Advantageously two subsequent detectors can be provided, the second of which—when detecting the oscillating moving element turnover—starts stoking material to the furnace, while, however, the first detector when the moving element passes, stops the stoking if started; the position of said two detectors is adjustable, along the moving element or preferably the eccentric projection trajectory in order to adjust the top level at which signalling takes place.

The invention will be better understood by following the description and the enclosed drawing, that shows a practical non-limitative embodiment of the invention itself. In the drawing:

FIGS. 1 and 2; 3 and 4; 5 and 6 show a side view and a section of a rotary cylindrical furnace with the apparatus at the lowering stage and in two conditions of high and low level of the material at the rising stage of the apparatus;

Figure 1:
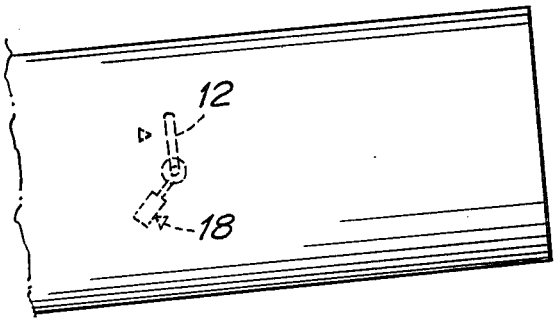

In the drawing 1 denotes the cylindrical shell of the rotary furnace for refuse, arranged with a slightly downwardly inclined axis and towards the discharge ends, so that the material fed at the higher end gradually moves forward, with the rotation of the cylinder towards the discharge outlet while it is gradually incinerated. Upon rotation in the direction of the arrow f1 of the cylinder, the material M during the incineration stage takes such a position that its level is slightly inclined, to a magnitude partly depending on the starting material features. The level of the material M varies according to the combustion running; for a good working of the furnace it is required that this level will not exceed certain maximum limits or be lower than certain minimum limits, that can be also experimentally adapted according to the basic and varying features of the material during a certain period of time, for example a season.

According to the invention the apparatus serves to evaluate the level of the material for the above mentioned purposes and also, if wished, to carry out a stroking control in order to restore a desired level, when a lowering excess of the level itself is observed. Several apparatuses can be provided in longitudinally spaced positions along the cylindrical furnace, so that several places along the axis can be checked, and also more than one in the same section orthogonal to the furance axis, in order to be able to check more frequently the level; moving elements can be positioned on the furnace shell, for example three at 120°, so that at any turn the level is checked three times.

According to the embodiment illustrated in the drawings, in one or in every longitudinal position in which a level checking is to be made on the outer wall 1A of the shell 1 a hollow 3 is provided in the refractory material layer 1B of said shell, in correspondence of which a support 5 is provided forming a base to which a sleeve-shaped member 7 with radial axis with respect to the cylindrical shell 1 can be fastened; the fastening can be carried out fixing a flange 7A to the base support 5 by means of bolts or the like. In the sleeve 7 bearings 9 for a shaft 10 are provided which shaft extends to form a measuring arm 12 with its part inside the furnace cylindrical shell; said arm 12 is deviated relative to the axis of the shaft-shaped part 10. For protection from heat and for elimination of the same, suitable windows can be provided both in the base support 5 and in the sleeve 7. The shaft 10 is a freely rotating shaft and a first counterweight 14 is engaged on it, said counterweight being designed to balance completely the rotary moving element formed by the counterweight and the member 10, 12. In addition to this balancing counterweight a further counterweight 16, is provided which is capable to impose an angular shifting to the moving element 10, 12, 14. The arm of the counterweight 14 is suited to cooperate with two pawls 18 and 20 projecting from the sleeve 7, so that the angular shiftings of the moving element 14, 14A, 10, 12 are limited between two positions shown with X and Y in the drawing; in the X position with the moving element resting on the pawl 18 a control is avoided, while in the Y position with the moving element resting on the pawl 20 a control is performed, in the way and for the purposes shown below. However a second control can be effected both in the X and Y position. To carry out these selective controls a control rod 22 integral with the moving element 10, 12, 14, 16, but eccentric with regard to the axis of the shaft 10, is provided.

Outside the cylindrical shell 1 a fixed structure is provided including a bowed rail 24 and extending equidistantly from the periphery of the shell. On said rail 24 in an adjustable position a guide shoe 26 is fitted that carries an arm 28 with a lateral appendix 28A. On arm 28 and appendix 28A two detectors 30 and 32 are placed that are subsequently met by the moving element unit when it passes along the raising trajectory length during rotation of the furnace in the direction indicated by the arrow f1. The first met detector 30 shows a small bar 30A which is always hit and shifted by the control rod 22, whatever will be the position taken by the moving element 10, 12, 14, 16. The secondly met detector 32 is in a back position with regard to the detector 30 or its small bar 32A is shorter, so that said small bar is hit and shifted by the control rod 22 only if the moving element 10, 12, 14, 16 is shifted in the Y position and therefore if the control rod 22 is in the 22X position where it interferes with the small bar 32A.

Figure 2:
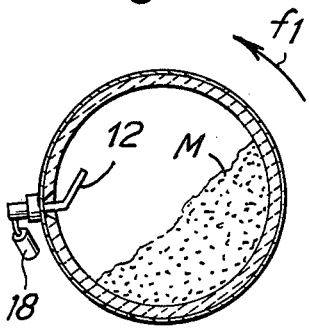
Figure 3:
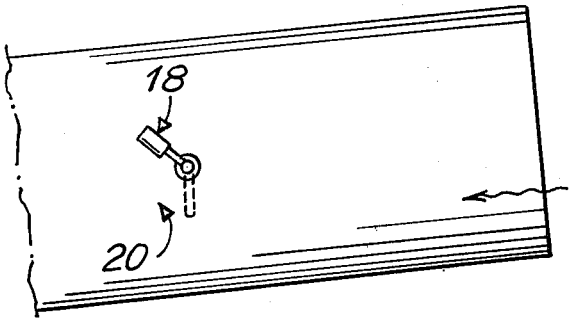
Figure 4:
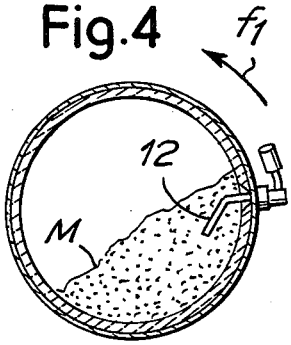
Figure 5:
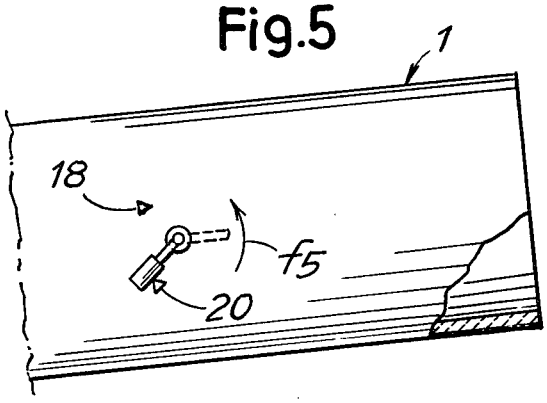
Figure 6:
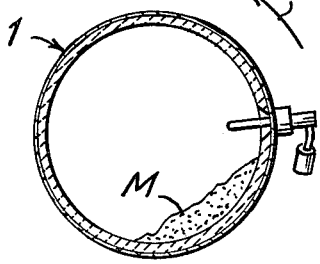
Figure 7:
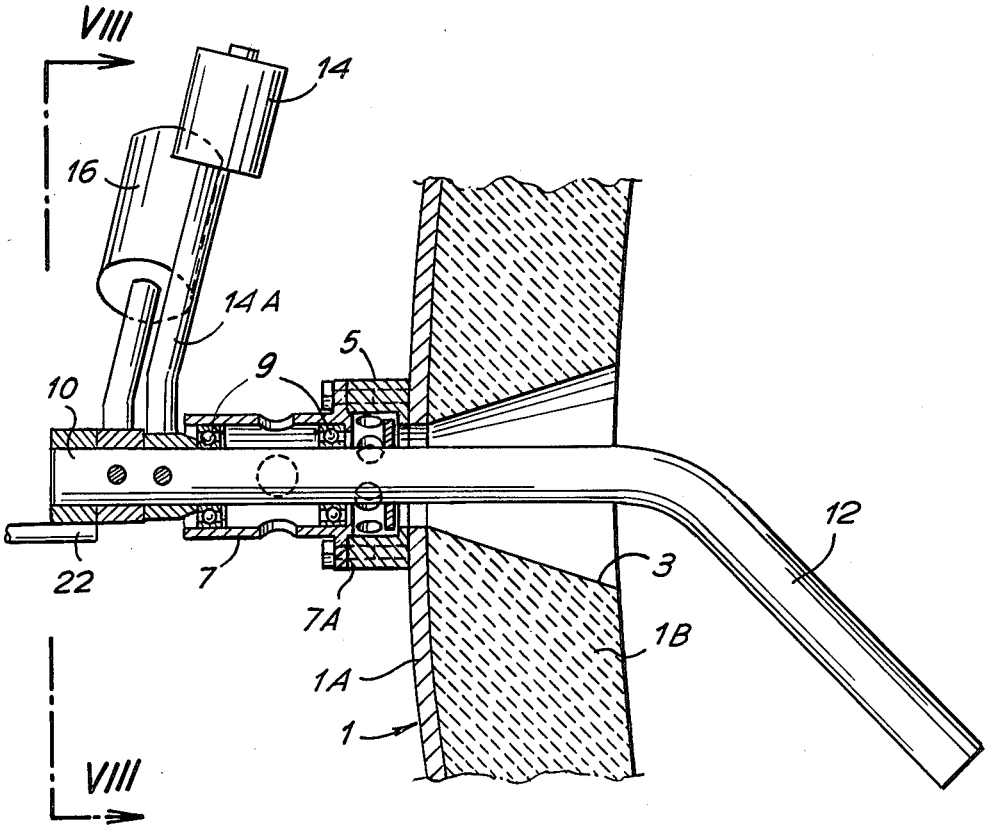
FIG. 7 shows the apparatus in a local diametral section of the furnace.
Figure 8:
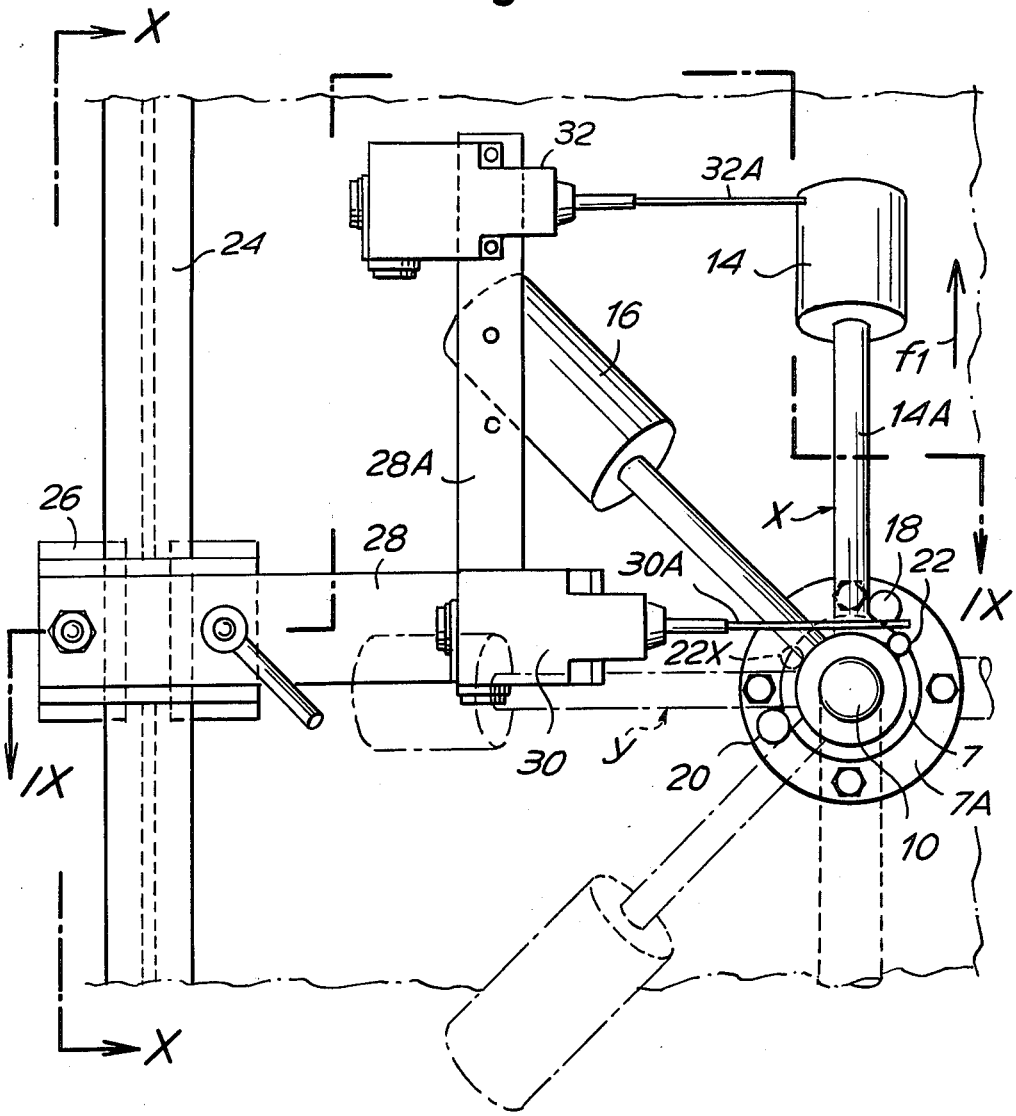
FIGS. 8, 9 and 10 show a view according to VIII—VIII of FIG. 7 and sections according to IX—IX and X—X of FIG. 8.
Figure 9:
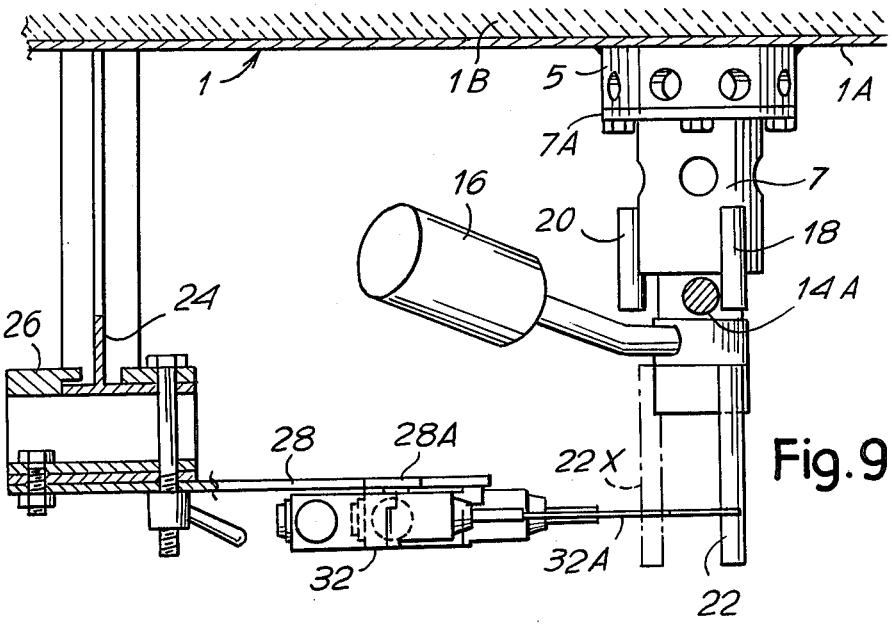
Figure 10:
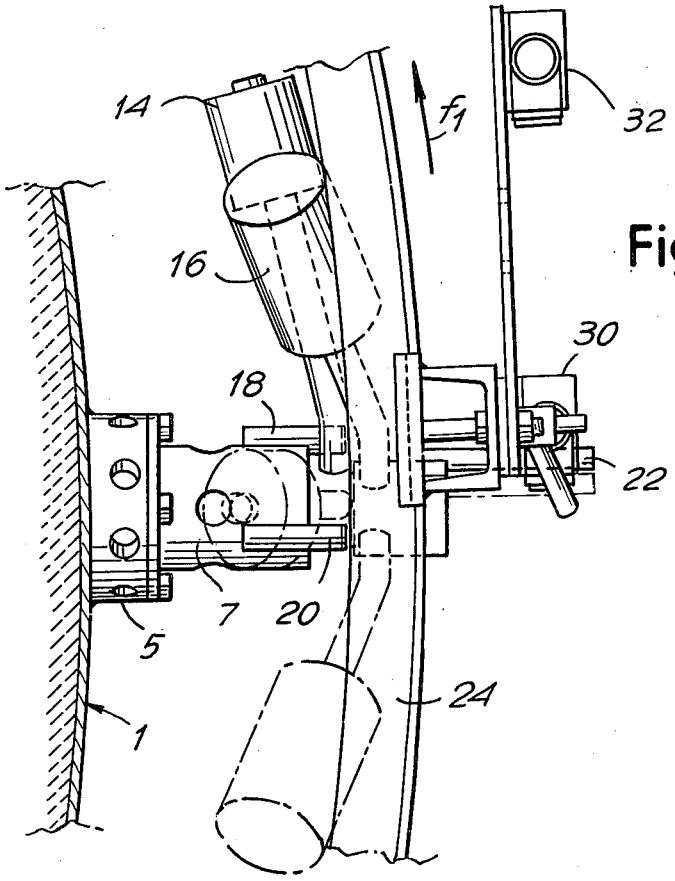

The two detectors 30 and 32 can be electric switches; the detector 30 operates the stoking stop of the material to be incinerated; this occurs at every rotation if the stoking is in progess; the secondly met detector 32 operates—only in case it is hit by the control rod 22—the start of the stoking which thus continues for almost one full furnace rotation, namely until the moving element unit reaches again before the detector 30. When, during rotation of the cylindrical furnace, the described apparatus travels a length of lowering trajectory (see FIGS. 1 and 2), the turnover counterweight 16 allows the moving element itself to rest on the pawl 18; this position corresponds to an upward position of the arm 12. In these conditions, namely with this position of the arm 12, the same arm penetrates into the material M during the continuation of its lowering trajectory. When the apparatus starts tracing its raising trajectory (namely when it is on the opposite part of the position shown in FIGS. 1 and 2) it is moved by the counterweight 16 to turnover and rest on the pawl 20; until the arm 12 is kept dipped in the mass of the material M (FIGS. 3 and 4), said moving element cannot rotate because the arm 12 cannot shift due to the material that surrounds it; therefore the moving element 10, 12, 14, 16, 22 maintains the same position as illustrated in FIGS. 3 and 4 (while resting on the pawl 18) if the level of the material M is relatively high as shown in these figures; else if the level of the material is lower, as shown in FIGS. 5 and 6, the arm 12 at that place of the raising trajectory has already emerged from the material M and thereby it can turnover according to the arrow f5 of FIG. 5 around the axis of the shaft 10, and rest on the pawl 20. If the quantity of the material is sufficient, that is if the level of the material is sufficiently high (conditions of FIGS. 3 and 4), the moving element maintains the X position and the control rod 22 does not operate the detector 32A, and consequently the stoking of the material is not started during one rotation. If the quantity of material is scarce, that is if the material is at a relatively low level (conditions of FIGS. 5 and 6) the moving element turns over in the Y position before passing opposite the detector 32, and the control rod 22 acts on the small bar 32A and detector 32, so that the stoking of the material is started. However, the stoking of the material stops after almost one rotation owing to the action that the moving element—in whatever position it may be—with the control rod 22 imposes to the detector 32. Thus, through subsequent corrections that is to say through subsequent stokings over one or more cycles, level increases of the material are obtained which restore the desired steady working conditions within the provided limits that can be adjusted by adjusting the guide shoe 26 position on the rail 24. Practically, corrections can be performed with more or less repetitions according to the extent of the stoking in the time unit with respect to each rotation of the rotary furnace.

It is understood that the drawing only illustrates an embodiment given just as a practical demonstration of the invention, which can vary in the forms and arrangements without however departing from the scope of the concept which informs the same invention.

What is claimed is:

1. A material level checking apparatus for mounting to the sidewall of a rotary refuse incinerating furnace comprising:

an element mounted for rotation through the sidewall of said furnace, said element rotating along an axis radial to the axis of rotation of said furnace;

an appendix disposed on said element and extending within the interior of said furnace;

weight means disposed on the other end of said element and external to said furnace, said weight means having a mass sufficient to cause said element and said appendix to rotate upon the rotation of said furnace;

first and second stop means disposed proximate to said element, said stop means limiting the rotation of said element between first and second angular positions;

said element contacting said first stop means when said element is moved in a downward direction due to the rotation of said furnace;

said element rotating from said first stop means to said second stop means when said element is moved upwardly due to the rotation of said furnace and when said appendix is out of contact with said material in said furnace; and said element being prevented from rotating from said first stop means to said second stop means upon being moved upwardly due to the rotation of said furnace when said appendix is in contact with said material in said furnace to thereby indicate the level of said material.

2. The apparatus as claimed in claim 1, wherein said first stop means defines the angular position of said appendix so that said appendix lies in a plane transverse to the axis of rotation of said furnace.

3. The apparatus as claimed in claim 1, further including detector means coupled to at least one of said first and said second stop means to thereby detect when said element is in contact with said stop means.

4. The apparatus as claimed in claim 1, further including counterweight means disposed externally of and opposite to said appendix to thereby rotationally balance said appendix, said weight means comprising a weight disposed at an angle with respect to said counterweight and said appendix.

* * * * *